US009659557B2

(12) United States Patent
Yang et al.

(10) Patent No.: US 9,659,557 B2
(45) Date of Patent: May 23, 2017

(54) ACTIVE CONTROL OF MEMBRANE-TYPE ACOUSTIC METAMATERIAL

(71) Applicant: THE HONG KONG UNIVERSITY OF SCIENCE AND TECHNOLOGY, Kowloon, Hong Kong (CN)

(72) Inventors: Zhiyu Yang, Hong Kong (CN); Ping Sheng, Hong Kong (CN); Min Yang, Hong Kong (CN); Suet To Tang, Hong Kong (CN); Guancong Ma, Hong Kong (CN); Songwen Xiao, Hong Kong (CN)

(73) Assignee: THE HONG KONG UNIVERSITY OF SCIENCE AND TECHNOLOGY, Hong Kong (CN)

( * ) Notice: Subject to any disclaimer, the term of this patent is extended or adjusted under 35 U.S.C. 154(b) by 0 days.

(21) Appl. No.: 15/022,456

(22) PCT Filed: Sep. 19, 2014

(86) PCT No.: PCT/CN2014/086939

§ 371 (c)(1),
(2) Date: Mar. 16, 2016

(87) PCT Pub. No.: WO2015/039622

PCT Pub. Date: Mar. 26, 2015

(65) Prior Publication Data

US 2016/0293154 A1 Oct. 6, 2016

Related U.S. Application Data

(60) Provisional application No. 61/960,478, filed on Sep. 19, 2013.

(51) Int. Cl.
*G10K 11/172* (2006.01)
*G10K 11/178* (2006.01)

(52) U.S. Cl.
CPC ..... *G10K 11/172* (2013.01); *G10K 11/1782* (2013.01); *G10K 11/1788* (2013.01);
(Continued)

(58) Field of Classification Search
CPC ..... G10K 11/172; G10K 11/1782; G10K 11/1788
(Continued)

(56) References Cited

U.S. PATENT DOCUMENTS 7,249,653 B2 * 7/2007 Sheng ..... E04B 1/86 181/207
7,395,898 B2 * 7/2008 Yang ..... G10K 11/172 181/286
(Continued)

FOREIGN PATENT DOCUMENTS

CN 101501990 A 8/2009
CN 101836095 A 9/2010
(Continued)

OTHER PUBLICATIONS

International Search Report for corresponding international application PCT/CN2014/086939 mailed Dec. 2, 2014.

*Primary Examiner* — Forrest M Phillips
(74) *Attorney, Agent, or Firm* — Nath, Goldberg & Meyer; Jerald L. Meyer; Stanley N. Protigal

(57) ABSTRACT

Sound attenuation is performed using a sound attenuation panel using an electromagnetic or electrostatic response unit to modify resonance. The sound attenuation panel has an acoustically transparent planar, rigid frame divided into a plurality of individual cells configured for attenuating sound. In one configuration, each cell has a weight fixed to the membrane. The planar geometry of each said individual cell, the flexibility of the membrane, and the weight establish a base resonant frequency for sound attenuation. The electromagnetic or electrostatic response unit is configured to modify the resonant frequency of the cell.

32 Claims, 7 Drawing Sheets

(52) U.S. Cl.
CPC ..... *G10K 2210/3212* (2013.01); *G10K 2210/32271* (2013.01)

(58) Field of Classification Search
USPC ..... 181/288
See application file for complete search history.

(56) References Cited

U.S. PATENT DOCUMENTS

| | | | | |
|---|---|---|---|---|
| 8,616,330 | B1 * | 12/2013 | McKnight | G10K 11/16 181/207 |
| 8,752,667 | B2 * | 6/2014 | McKnight | G10K 11/172 181/207 |
| 8,857,564 | B2 * | 10/2014 | Ma | G10K 11/18 181/284 |
| 8,869,933 | B1 * | 10/2014 | McKnight | G10K 11/172 181/207 |
| 9,076,429 | B2 * | 7/2015 | Islam | G10K 11/172 |
| 2013/0087407 | A1 | 4/2013 | McKnight et al. | |
| 2014/0116802 | A1 * | 5/2014 | Ma | G10K 11/18 181/286 |
| 2016/0104472 | A1 * | 4/2016 | Sheng | G10K 11/172 181/288 |

FOREIGN PATENT DOCUMENTS

| | | | |
|---|---|---|---|
| CN | 102237079 | A | 11/2011 |
| JP | 2012-100040 | A | 5/2012 |

* cited by examiner

ACTIVE CONTROL OF MEMBRANE-TYPE ACOUSTIC METAMATERIAL

This is a National Phase Application filed under 35 U.S.C. 371 as a national stage of PCT/CN2014/086939, filed Sep. 19, 2014, and claiming the benefit from U.S. Provisional Application No. 61/960,478, filed Sep. 19, 2013, the content of each is hereby incorporated by reference in its entirety.

BACKGROUND

Field

The present disclosure relates to novel sound attenuating structures in which locally resonant sonic materials (LRSM) act as membrane-type acoustic metamaterials (MAMs). The MAMs are able to provide a shield or sound barrier against one or more particular frequency ranges as a sound attenuation panel. More particularly, the disclosure relates to active control or adjustment of such panels by electromagnetic, electrostatic or other means.

Background

Sound attenuation panels are described in U.S. Pat. No. 7,395,898, which discloses a rigid frame divided into a plurality of individual cells, a sheet of a flexible material, and a plurality of weights. Each weight is fixed to the sheet of flexible material such that each cell is provided with a respective weight and the frequency of the sound attenuated can be controlled by suitable selecting the mass of the weight. The flexible material may be any suitable soft material such as an elastomeric material like rubber, or another soft material such as nylon. The flexible material is ideally impermeable to air and without any perforations or holes; otherwise the sound attenuation effect is significantly reduced. The rigid frame may be made of a material such as aluminum or plastic. The function of the frame is for support and therefore the material chosen for the frame is not critical provided it is sufficiently rigid and preferably lightweight.

In the above configuration, a single panel may attenuate only a relatively narrow band of frequencies. A number of panels may be stacked together to form a composite structure so that each panel is formed with different weights and thus the resultant panel attenuates a different range of frequencies in order to increase the attenuation bandwidth.

It would be desirable if the individual cells could be adjusted in order to adjust the range of frequencies attenuated by the individual cells, and consequentially the range of frequencies of the panel could be adjusted.

SUMMARY

An acoustically transparent planar, rigid frame and sheet of a flexible material fixed to the rigid frame, is divided into individual cells configured for attenuating sound. Each cell has a weight fixed to the membrane. The planar geometry of each said individual cell, the flexibility of said flexible material and the weights establish a base resonant frequency of said sound attenuation. One or more of the cells having an electromagnetic or electrostatic response unit configured to modify the resonant frequency of the cell.

BRIEF DESCRIPTION OF THE DRAWINGS

FIG. 4A is a drawing showing a pair of electrodes that produces the electric field. FIG. 4B is a plot showing the electric field in a direction perpendicular to the membrane plane and on the central axis of the membrane-platelet structure.

FIG. 6A shows transmission spectra of the sample with different DC voltages applied to the sample. Solid curves denote the amplitude (left axis) while dashed curves (right axis) represent the phase spectra. FIG. 6B shows phase shift (left axis with positive slope) and the resonance frequency change (right axis with negative slope).

FIG. 9A shows membrane with film and a mesh grid. FIG. 9B shows the arrangement as assembled. FIG. 9C is a front view of membrane, showing concentric ring electrodes.

FIG. 10A shows a cross-sectional side view of a two-cell combined unit for active sound wave cancellation. FIG. 10C shows a two-cell combined unit with substantial empty channel for air flow.

DETAILED DESCRIPTION

Overview

Figure 1:
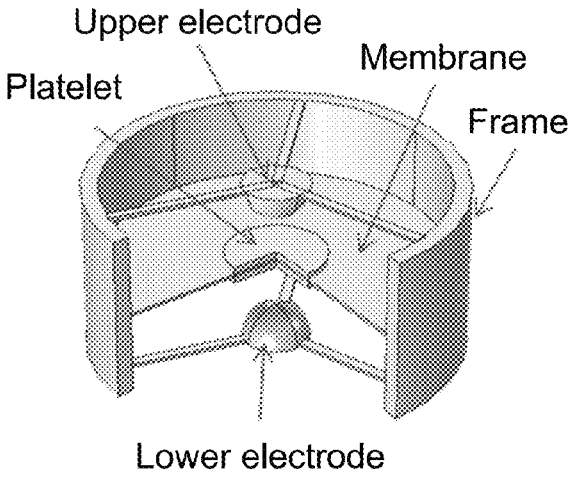
FIG. 1 is a schematic drawing of a structural unit containing a generic pair of electrodes for electric field tuning of the working frequency of the sound attenuation structure.
Figure 2:
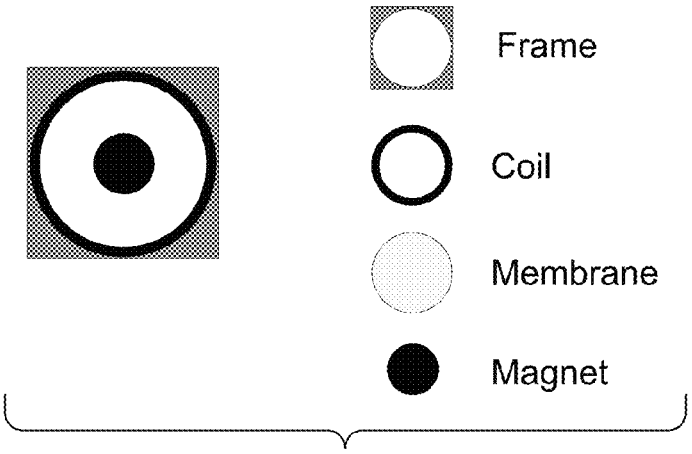
FIG. 2 is a schematic drawing of a structural unit using a magnetic field generated by an electric current in the coil.

FIG. 1 is a schematic drawing of a structural unit containing a generic pair of electrodes for electric field tuning of the working frequency of the sound attenuation structure. FIG. 2 is a top view of the components structural unit for tuning the working frequency by the magnetic field generated by the electric current in the coil.

The sound attenuation structure of FIGS. 1 and 2 includes an electromagnetic or electrostatic response unit providing a transducer function. The electromagnetic or electrostatic response unit is able to modify the resonant response of the structural unit. Further, as a transducer, the electromagnetic or electrostatic response unit is able to sense acoustic vibrations or waves and provide information concerning the acoustic vibration or waves for external detection of the presence of acoustic sources and to provide feedback for purposes of adjusting the resonant frequency of the sound attenuation structure.

With the addition of either specially designed electrodes or an electrically conducting wire coil, the working frequency of the sound attenuation structures can be tuned by either the electric voltage across the electrodes (FIG. 1) or the electric current through the coil (FIG. 2). Metallic mash can be used for the electrodes to make them as sound wave transparent as possible.

The electrodes shown in FIGS. 1 and 2 are generic and for illustration purpose only. The actual shapes of the electrodes can be quite different in order to obtain the desired field distribution. Below are two non-limiting examples, one example implementing electric field tuning and the other example implementing magnetic field tuning.

By employing a metal-coated central platelet and a fishnet electrode which is transparent to acoustic waves, the present disclosure shows that the membrane-type acoustic metamaterials (MAMs) can be easily tuned by applying an external voltage. With static electric field the MAM's eigenfrequencies are tunable up to 70 Hz. The phase of the reflected or the transmitted wave can thereby be tuned when the sound wave frequency falls within the tunable range. The MAM's vibration can be significantly suppressed or enhanced by using phase-matched AC voltage. Functionalities, such phase modulation and controllable acoustic switch with on/off ratios up to 21.3 dB, are demonstrated.

The development of acoustic metamaterials has significantly enhanced design capabilities in sound wave manipulation. Acoustic metamaterials' unusual constitutive effective parameters, usually not found in nature, have led to numerous remarkable phenomena such as acoustic cloaking, acoustic focusing and imaging beyond diffraction limit, nonreciprocal transmission, and super absorption. To date, most metamaterials are passive, with minimum adjustment capability once fabricated. As a result, such metamaterials cannot adapt to real-life scenarios that are likely to change constantly as a function of time. One promising way to mitigate these problems is to incorporate active designs. According to the present disclosure, acoustic properties of membrane-type metamaterials (MAMs) can be controlled by external voltage to achieve a number of functionalities, such as phase modulation and acoustic wave switch.

The structures, comprising decorated membrane resonators (DMRs), have been studied previously. It is known that the low frequency transmission and reflection characteristics of a DMR are mainly determined by its first two eigenmodes. Transmission peaks at these resonant frequencies, and total reflection occurs at the anti-resonance frequency between the resonant frequencies. To demonstrate the actively controllable functionality, an analysis of the first eigenmode is used.

The basic structure of the sound attenuation structure in existing MAMs comprises a two dimensional array of structural units, each unit or cell consisting of a rigid boundary, an elastic membrane fixed on the boundary, and a weight attached to the center of the membrane. Each cell has an inherent resonant frequency which can be modified by an electromagnetic or electrostatic response unit or electromagnetic transducer.

In one configuration, the MAMs provide a sound attenuation panel comprising a substantially acoustically transparent planar, rigid frame divided into a plurality of individual cells, generally provided as two-dimensional cells. Each cell comprises a sheet of elastic material fixed on the cell frame, and one platelet attached to the sheet. The flexible materials can be either impermeable, such as rubber or plastic sheet, or permeable to air, such as open weave elastic fabric such as used in athletic apparel. The sheet can also be made in multiple layers. A pair of electrodes is placed near the platelet, one electrode above the platelet and one electrode below the platelet. The materials type of the platelet is either dielectric or metallic. A plurality of the panels may be stacked together.

The cells may each be provided with a platelet. In such a configuration of one electrode above the platelet and one electrode below the platelet, resonant frequency of the sound attenuation structure is defined by the planar geometry of each individual cell, the flexibility of the flexible material and the platelet, and the electric voltage difference between the electrodes.

In an alternative configuration, front and back sides of the same membrane are provided with conductive electrodes. In a specific non-limiting example, one side of the membrane is coated with a thin conductive film, such as a gold film. The opposite side of the same membrane from the conductive film has a mesh grid in contact with the membrane. The distance between the front and back electrodes is then determined by the thickness of the membrane, and can be maintained precisely, with the back electrodes provided as two concentric rings.

In another configuration, the platelet is made of permanent magnetic materials and an electric conducting wire coil is placed on the boundary of the structural unit.

In another configuration, each cell is provided with a platelet, and a wire coil is fixed on the boundary. The resonant frequency of the sound attenuation structure is defined by the planar geometry of each individual cell, the flexibility of the flexible material and platelet, and the electric current through the coil.

In order to modify the resonant response of the MAMs, at least a plurality of the cells have an electromagnetic or electrostatic response units capable of modifying the resonant frequency of the cell.

The arrangement allows active sound wave manipulations, including detection, processing, and emission of sound waves in close correlation in phase and amplitude with the incoming sound waves.

Working Principle

Figure 3:
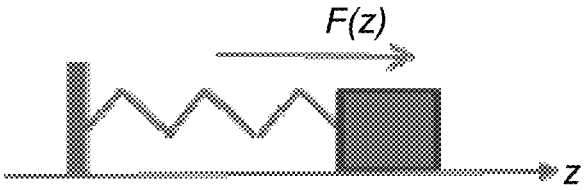
FIG. 3 is a schematic drawing of a simplified membrane-platelet system in an external force field.

FIG. 3 is a schematic drawing of a simplified membrane-platelet system in an external force field, showing the external force field is in addition to the restoring force from the membrane. Suppose the central weight in each structural unit is subject to a non-uniform field force F(z) along the Z-direction perpendicular to the 2D membrane. Therefore, the restoring force from the membrane is approximated by an ideal spring. Such a force field can be realized by a non-uniform electric field generated by a pair of non-planar electrodes maintained at different electric potential while the central weight is made of either dielectric or metallic substance, or by a non-uniform magnetic field generated by an electric current coil while the central weight is made of permanent magnetic substance. For small displacement from the membrane plane, with zero displacement being z=0, the membrane can be considered as an ideal spring with force constant k. At $z_0$ the field force balances the membrane force, i.e., $$z_0=F(z_0)/k \tag{1}$$

For a small displacement from the balance position, the net force is:

$$\delta F=\left(-k+\frac{dF}{dz}\bigg|_{z=z_0}\right)(z-z_0). \tag{2}$$

So the effective force constant is:

$$k_{eff}=k-\frac{dF}{dz}\bigg|_{z=z_0}. \tag{3}$$

The first eigenmode frequency of the membrane-weight structure is given approximately by:

$$f = \frac{1}{2\pi}\sqrt{\frac{k_{eff}}{m}}, \tag{4}$$

where m is the mass of the weight.

Example-1

Electric Field

Figure 4A:
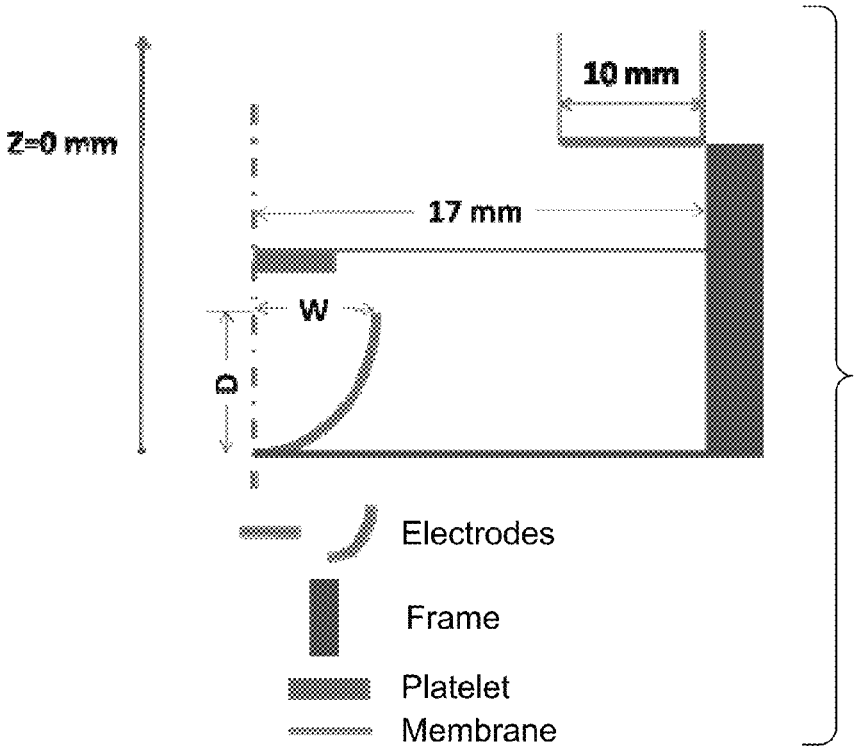
FIGS. 4A and 4B are schematic drawings showing the effect of electrode position.
Figure 4B:
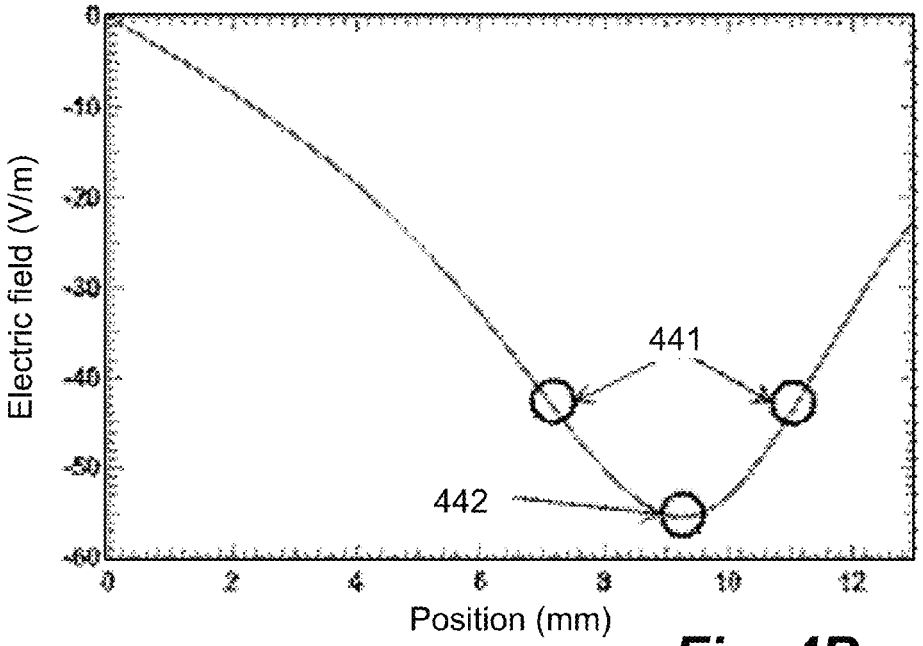

FIGS. 4A and 4B are schematic drawings showing the effect of electrode position. FIG. 4A is a drawing showing a pair of electrodes that produces the electric field. FIG. 4B is a plot showing the electric field in a direction perpendicular to the membrane plane and on the central axis of the membrane-platelet structure when the voltage difference between the electrodes is 1.0 volt.

The central weight in disk shape is polarized by the electric field to form an electric dipole p=A·E(z), where A is a constant depending on the disk dimension and material property. The force on an electric dipole is:

$$F_E = p \cdot \frac{dE}{dz}. \tag{5}$$

So the electric field force is:

$$F_E(z) = p \cdot \frac{dE}{dz} = A \cdot E(z) \cdot \frac{dE}{dz} \tag{6}$$

Put into Eq. 3, we have $$\left.\frac{dF}{dz}\right|_{z=z_0} = A\left(\left.\frac{dE}{dz}\right|_{z=z_0}\right)^2 + A \cdot E(z_0)\left.\frac{d^2E}{dz^2}\right|_{z=z_0} = -k_{E1} - k_{E2}. \tag{7}$$

The first term in Eq. 7 is always positive so its contribution is to lower the eigenfrequency. The second term can be positive or negative, so it can increase or decrease the eigenfrequency. The cross section of a particular pair of electrodes with cylindrical symmetry is shown in FIG. 4A. The upper ring-shaped electrode is attached to the frame, while the lower electrode is in hollow-bowl shape supported by thin rods extended from the frame. Both electrodes are of negligible thickness. Shown in FIG. 4B is the electric field at 1.0 V of potential difference between the electrodes with D=3.0 mm and W=4.0 mm, which is obtained by numerical simulations. Placing the membrane/weight at different z-position would lead to different field tuning effect. Here two positions are selected as examples. One is on the side wall of the cone-shaped electric field (marked as position 441) where $$\left.\frac{dE}{dz}\right|_{z=z_0}$$

is large but $$\left.\frac{d^2E}{dz^2}\right|_{z=z_0}$$

is near zero, as the electric field there is nearly linearly dependent on position z. The other is at the bottom of the cone (marked as position 442) where $$\left.\frac{d^2E}{dz^2}\right|_{z=z_0}$$

is non-zero but $$\left.\frac{dE}{dz}\right|_{z=z_0}$$

is 0.

For an eigenfrequency of 100 Hz with weight mass m=1.0 g, the force constant due to the membrane is:

$$k=m(2\pi f)^2 \approx 4 \text{ N/m}. \tag{8}$$

For a disk shaped weight, its dipole moment due to an electric field of 1.0 V/m is about $1.5\times10^{-8}$ A·s·m.

If the weight is placed at position-1 where the position dependence of the field is nearly linear, then $$\frac{d^2E}{dz^2} \approx 0,$$

so only the first term in Eq. 7 contributes:

$$k_{E1} = A\left(\frac{dE}{dz}\right)^2 = -1.5\times10^{-8}(9\cdot10^3) = -1.2 \text{ N}/m. \tag{7b}$$

The magnitude of the effective force constant due to the electric field is smaller but comparable to that of the membrane, so the working voltage should be set around 1 volt. The change of electric force is opposite of the membrane so the effective force constant is reduced by the electric field. Therefore, the applied field will reduce the eigenfrequency.

At position-2, $$\frac{dE}{dz} = 0$$

so there is no initial force due to the field. The second term in Eq. 7 provides an effective force constant:

$$k_{E2} = -A \cdot E \cdot \frac{d^2 E}{dz^2} = -1.5 \cdot 10^{-8} \cdot 55 \cdot 4 \cdot 10^4 = -3.3 \cdot 10^2 \text{ N}/m. \quad (7c)$$

As the field force is proportional to square of the voltage, applying 7 volts to the electrodes will produce $k_2$=−1.6 N/m, so the working voltage should be set around 7 V. The change of electric force is opposite of the membrane so the effective force constant is reduced by the electric field.

Example-2

Magnetic Field by a Coil

In this case the central platelet is a permanent magnet with dipole moment M, and the magnetic field by the coil is:

$$B_z = \frac{\mu_0 I a^2}{2(z^2 + a^2)^{3/2}}, \quad (9)$$

where a is the radius of the coil carrying electric current I.

The magnetic field force is $$F_M = M \frac{dB}{dz},$$

which is zero at z=0, i.e., when the membrane is placed in the plane of the coil:

$$k_M = -\left.\frac{dF}{dz}\right|_{z=0} = -M \left.\frac{d^2 B}{dz^2}\right|_{z=0} = -\frac{5\mu_0 IM}{2a^3} \quad (10)$$

For a=1 cm, I=1.0 A, and a typical 1.0 g magnet disk M=0.02 A·m$^2$, so:

$$k_M \approx -0.6 \text{ N/m}, \quad (11)$$

which is in the suitable range for eigenfrequency tuning.

Example 3

Fishnet Rigid Mesh

Figure 5:
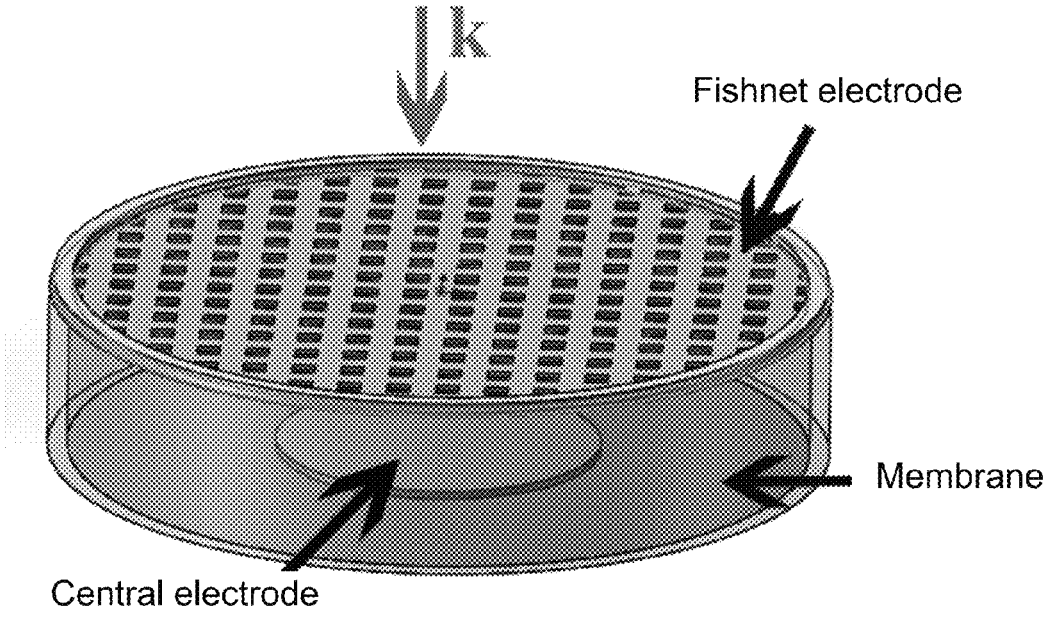
FIG. 5 is a schematic diagram of a decorated membrane resonator (DMR).

FIG. 5 is a schematic diagram of a decorated membrane resonator (DMR). The DMR comprises a circular rubber membrane with radius R=27 mm and t=0.15 mm in thickness. Its boundary is fixed on a solid ring and pre-stress has been applied in the membrane. A circular plastic disk with radius r=15 mm, and mass m=400 mg is attached to the center of the membrane. The surface of the disk is coated with a thin layer of gold about 20 nm thick by sputtering. A fishnet rigid mesh shown in FIG. 5 is coated with gold film and placed above the membrane. Large hollow area of the mesh minimizes its scattering to the passing acoustic waves.

The effect of a DC voltage U across the fishnet electrode and the central disk-shaped mass on the membrane is first analyzed. The fishnet electrode and the central disk-shaped mass on the membrane serve as the two electrodes of a parallel plate capacitor. When excited by incident acoustic wave, the vibration of the membrane introduces a small harmonic variation in the distance between the electrodes. Assuming that the mesh does not deform, the electric force exerted on the disk is:

$$F_{DC} \cong -\frac{1}{2}\frac{\varepsilon S U^2}{(d+\Delta z)^2} \approx -\frac{\varepsilon S U^2}{2d^2}\left(1 - 2\frac{\Delta z}{d}\right) \approx -F_0 + \overline{K}\Delta z, \quad (12)$$

where S is the effective area of the disk electrode, $\in \approx 1$ represents the dielectric constant of air, U is the amplitude of the applied voltage, and d is the separation between the mesh and the disk at zero voltage.

The electric force can be clearly divided into two parts: a constant attractive force $F_0$, and a force that is linearly proportional to the disks normal displacement Δz, with effective force constant $\overline{K} = \in SU^2/d^3$ 'The first term $F_0$ (<0.1N) merely shifts the equilibrium position of the membrane slightly whereas the second force is equivalent to an extra anti-restoring force on the disk. Since the central disk vibrates together with the membrane at the first resonance mode at 164 Hz, it could be described by a simple spring-mass model with eigenfrequency:

$$f = \frac{1}{2\pi}\sqrt{\frac{K}{m}} \approx \frac{1}{2\pi}\sqrt{\frac{K_0 - \overline{K}}{m}}, \quad (13)$$

where $K_0$ comes from the membrane's pre-stress.

This can be estimated as:

$$K_0 m (2\pi f_0)^2 \approx 425 \text{ (N/m)} \quad (14)$$

It is then clear that the eigenfrequency will decrease as a result of the additional $\overline{K}$. On the other hand, $\overline{K}$ is inversely proportional to $d^3$. To maximize the effect, a very small value d=0.4 mm is chosen. In that case $\overline{K}$ is approximately $2.0 \times 10^{-4} U^2$ (N/m).

Figure 6A:
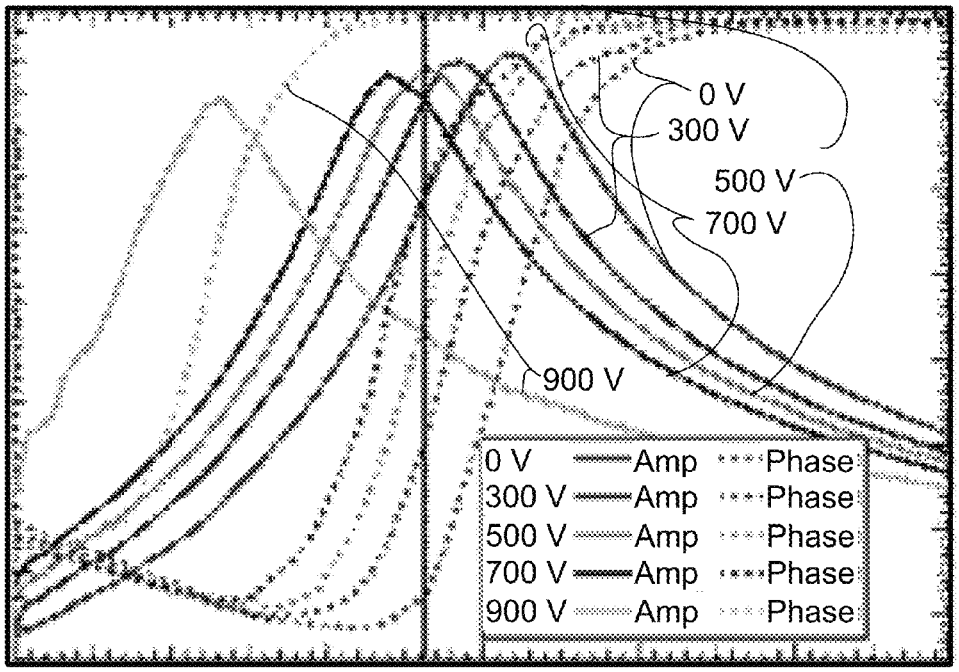
FIGS. 6A and 6B are graphs showing acoustic response of a sample constructed according to FIG. 5.
Figure 6B:
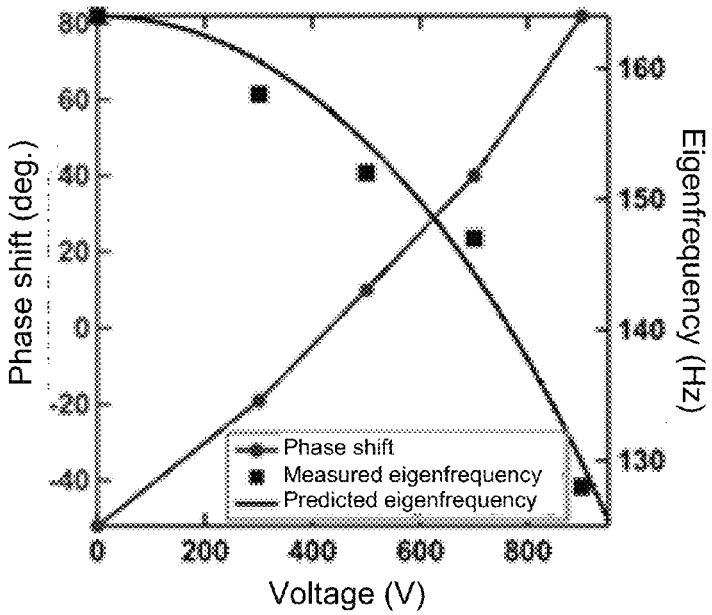

FIGS. 6A and 6B are graphs showing acoustic response of a sample constructed according to FIG. 5. FIG. 6A shows transmission spectra of the sample with different DC voltages applied to the sample. Solid curves denote the amplitude (left axis) while dashed curves (right axis) represent the phase spectra. FIG. 6B shows phase shift (left axis and line with positive slope. The phase shift is taken at 153 Hz, corresponding to the vertical line in FIG. 5A. Also depicted in FIG. 6B is the resonance frequency change for the sample with voltage (right axis and line with negative slope). The measured values are marked by black squares and the predicted resonance frequency from the spring-mass model is shown as the negative slope curve.

A modified impedance-tube method was used to obtain the transmission spectra, as shown in FIG. 6A. The transmission peak, which signifies resonance, is seen to red-shift with increasing DC voltage. In FIG. 6B the measured eigenfrequency as a function of the DC voltage and the one predicted by the simple effective force constant. Good agreement is obtained.

Resonant transmission of the DMR is accompanied by a 180° phase change. With tunable eigenfrequencies, the DMR can function as an active phase modulator. As shown in FIG. 6A, the phase of the transmitted wave can be varied continuously from −55° at zero U to 81° at U=900 V at 153 Hz, which is marked by the vertical line in FIG. 6A, a total phase shift of 136°.

Figure 7:
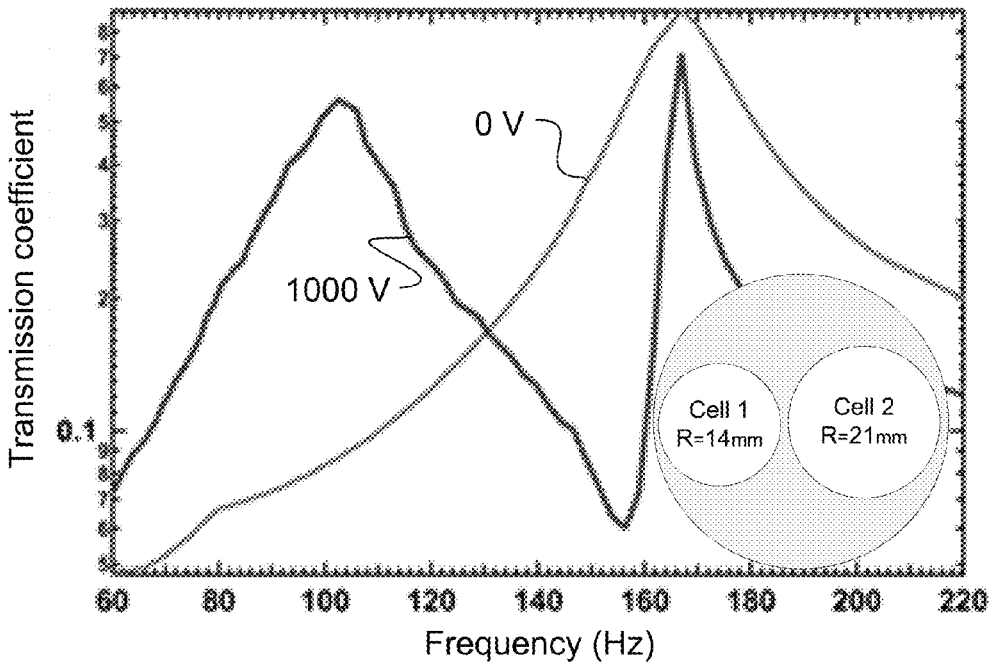
FIG. 7 is a graph showing the effect of a DC voltage controlled acoustic switch with two DMRs.

The ability to tune the resonance frequency with static electric field allows us to construct a simple acoustic switch. FIG. 7 is a graph showing the effect of a DC voltage controlled acoustic switch with two DMRs. The one with electrodes is cell 2, while cell 1 is passive. The trace with one peak is taken at 0 volts, and the trace with two peaks is taken at 1000 V. Two DMRs are used, as shown in the insert of FIG. 7.

The resonance frequencies of the two cells are originally set to be the same so that a single transmission peak appears at 166 Hz. After a voltage is applied in cell 2, its resonance frequency is lowered. As stated before, its transmission field shall have a nearly 180° phase change across the new resonance frequency. Hence within the frequency region between the current resonance frequencies of the two cells, the transmitted fields through these two passageways are essentially out of phase, causing destructive interference. A transmission dip appeared at 156 Hz where the transmitted intensities from the two units are nearly equal. The transmission contrast over zero voltage is 21.3 dB (0.7/0.06).

AC voltage with angular frequency ω is then applied between the electrodes. The electric force on the disk can be expressed as:

$$F_{AC} \propto -\frac{U^2}{d^2} = -\frac{A^2\sin^2(\omega t+\theta)}{d^2} = \frac{A^2}{2d^2}[-1+\cos(2\omega t+2\theta)] \tag{15}$$

Here A and w are the amplitude and the frequency of the AC voltage, respectively, and θ is the initial phase. It is noted that the out-of-plane displacement of the membrane leads to a negligible $\overline{K}$, because the 2 mm gap is much larger than that in the previous case. Therefore d can be regarded as a constant. The force is considered to have two parts: a nearly constant force and a harmonic force with angular frequency 2ω. To manipulate the sound wave, this frequency ω always satisfies the relation: $2\omega=\omega_s$, where $\omega_s$ is the frequency of the incident plane wave.

In addition, the harmonic force is sensitive to the relative phase 2θ between the AC voltage and the incident sound wave. Its effect is seen for the first eigenmode, in which the central disk vibrates with the membrane in unison. The electric force can either enhance or suppress the vibration of the disk. By changing 2θ from 0 to π, the role of the harmonic electric force can be continuously altered from gain to loss.

Figure 8:
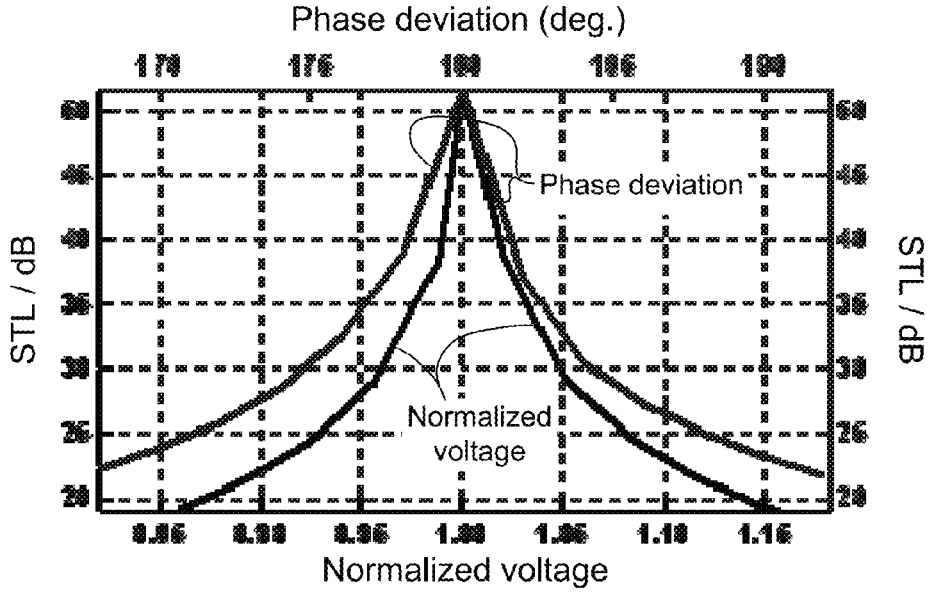
FIG. 8 is a graph showing sound transmission loss (STL) of the sample at the resonance frequency as compared to the transmission when no voltage is applied. The lower curve is the dependence of transmission on the amplitude of AC voltage normalized to the optimal voltage.

FIG. 8 is a graph showing sound transmission loss (STL) of the sample at the resonance frequency as compared to the transmission when no voltage is applied. The lower curve is the dependence of transmission on the amplitude of AC voltage normalized to the optimal voltage. A panel with optimum sound manipulation has a high adjustable STL, so it is desirable to increase tunable STL for sound manipulation attenuation or absorption purposes.

In order to obtain large sound transmission loss, optimum amplitude of the voltage should be identified so as to totally counteract the sound pressure, as well as keep the phase condition 2θ=π. To investigate the dependence of the amplitude and the phase condition separately, the amplitude and the initial phase of the AC voltage is identified, in order to satisfy the two conditions to obtain highest sound transmission loss (STL) of 52 dB as compared to zero voltage. Then the amplitude of the AC voltage is tuned while keeping the phase to its optimum value. Referring to FIG. 8, the STL drops quickly when the AC amplitude deviates from the optimum condition. Then the optimum amplitude of the voltage is maintained while changing the initial phase. About 13 dB in STL was observed when the initial phase changed only 2 degrees. This phase sensitive characteristic provides a promising method to detect small phase variations. For example, 0.025 degree of phase shift would cause 5% relative change in transmission, which is easily detectable.

Since the vibration profile is quite similar around the resonant frequency within a wide range, the above method is applicable in the adjacent frequency region. STL level exceeding 40 dB could be achieved in the nearby ±40 Hz range. Gain effect can also be demonstrated once the initial phase of the voltage was set so that the electric force becomes in-phase with the sound pressure.

As can be seen, with the assistance of an externally applied electric voltage, active control of the membrane-type acoustic metamaterials can be achieved. DC voltage can be used to modulate the resonance frequency and tune the phase, serving as an active phase modulator in a phase array that could manipulate sound waves at will. AC voltage provides an extra vibration source that can act as an acoustic switch, and can thereby serve as a good candidate to be used at specific surroundings within certain frequency ranges.

Electrodes with Minimized Gap Distances

Figure 9A:
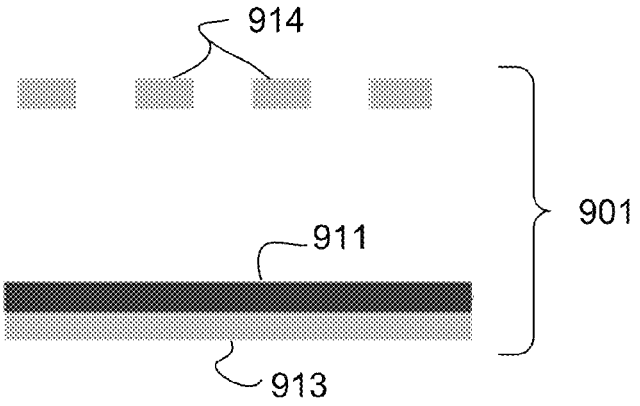
FIGS. 9A-9C are schematic diagrams showing a configuration in which a membrane is provided with two electrodes, respectively positioned on opposite sides of the membrane.
Figure 9B:
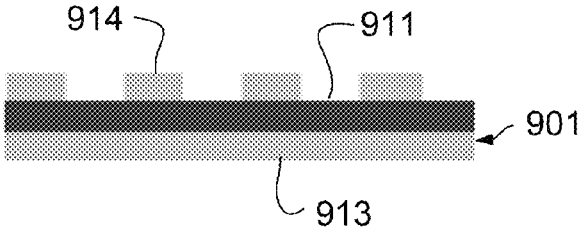
Figure 9C:
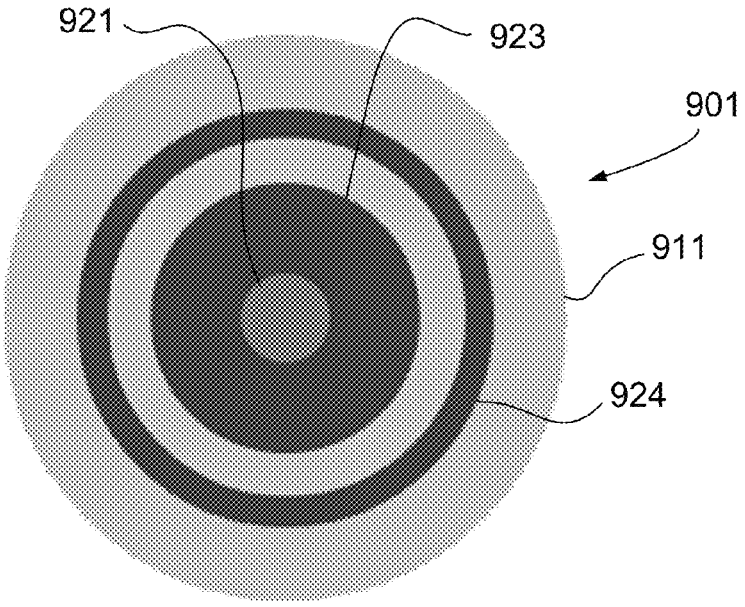

In order to reduce the operation voltage in the structure in an electric field arrangement, the gap distance between the two electrodes must be further reduced; however, smaller gap distances are difficult to maintain. FIGS. 9A-9C are schematic diagrams showing a configuration for a DMR 901 in which a membrane is provided with two electrodes, respectively located on opposite sides of the membrane. FIG. 9A shows membrane 911, with gold film 913 coated on membrane 911. Mesh grid 914 is positioned on the opposite side of membrane 911 from gold film 913. FIG. 9B shows the arrangement as assembled, with mesh grid 914 positioned on membrane 911. FIG. 9C is a front view of membrane 911, showing platelet 921 and concentric ring electrodes 923, 924 used to connect gold film 913 and mesh grid 914. The ring electrodes are thin films coating on the membrane. The mesh is originally detached from the membrane, and brought in contact with the membrane when the device is assembled.

In the configuration of FIGS. 9A-9C, instead of putting an electrode on platelet 921, one side of membrane 911 is coated with thin gold film 913. Gold film 913 contains concentric ring electrodes 923, 924. Voltage can be applied separately between 923 and 914, or 924 and 914 in order to make the corresponding portion of the membrane immobile. The distance between the electrodes is then determined by the thickness of membrane 911, and can be maintained precisely.

When no voltage is applied between mesh electrode 914 and the ring electrodes 923 and 924, the whole membrane 911 can vibrate which gives rise to resonance of DMR 901 in accordance with the flexibility of membrane 911, the area of membrane 911 and the weight of platelet 921. When a voltage is applied between outer ring electrode 924 and mesh electrode 914, the resultant electrostatic force will hold this part of membrane 911 firmly to the mesh 914 to turn it immobile. The effective membrane size of DMR 901 is reduced to only the part within the inner edge of outer ring 924, and the resonant frequency of DMR 901 is increased significantly. When a voltage is applied between inner ring electrode 923 and mesh electrode 914, this part of membrane 911 is also fixed so the resonant frequency of DMR 901 is further increased. By coating membrane 911 with a series of concentric ring electrodes, the effective size of the membrane can be adjusted by the applied voltage between the individual rings and the mesh electrode, thereby controlling the resonant frequency of DMR 901 over a large frequency range. The mesh 914 may be provided with an empty central opening with diameter equal to that of the inner diameter of the smaller metal ring on the membrane 923.

Field-Driven Sound Sources

Figure 10A:
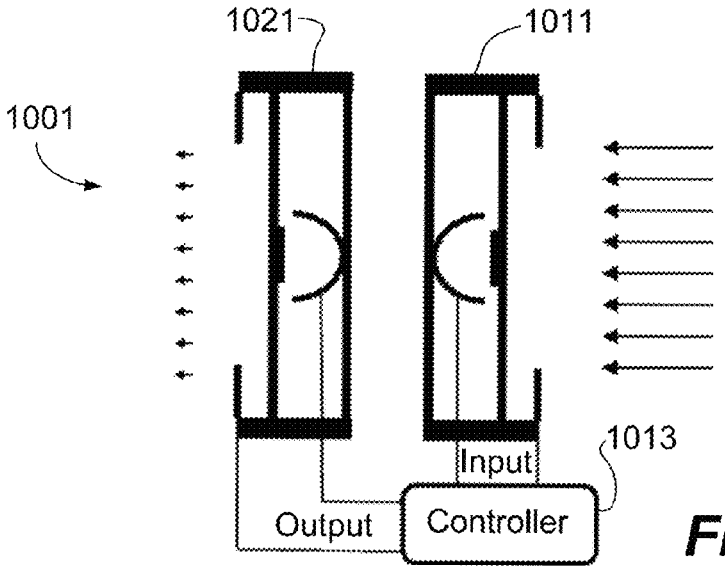
FIGS. 10A and 10C are schematic drawings showing a two-cell combined unit.
Figure 10B:
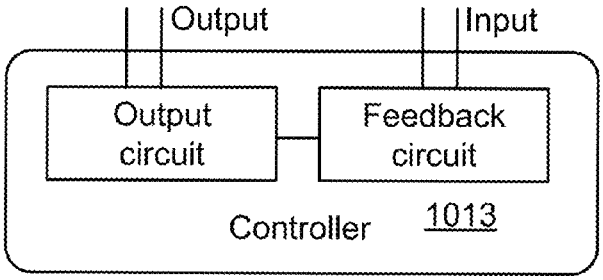
FIG. 10B shows details of the controller used in FIG. 10A.
Figure 10C:
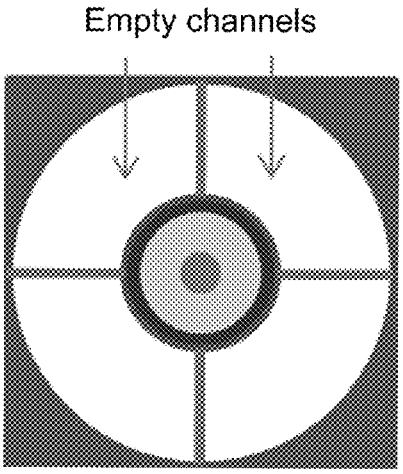

FIGS. 10A and 10C are schematic drawings showing a two-cell combined unit. FIG. 10A shows a cross-sectional side view of a two-cell combined unit for active sound wave cancellation. FIG. 10B shows details of the controller used in FIG. 10A. FIG. 10C shows a two-cell combined unit with substantial empty channel for air flow.

For the cases when there is an initial force due to external field on the platelet, such as in the case when the platelet is placed in 441 in the electric field (FIG. 4B), the field can act as a source to drive the membrane to emit sound waves instead. The sound wave frequency is the same as the driving alternating electric voltage. The DC voltage sets the eigen-frequency to be close to the driving voltage frequency so the emission will be the most efficient. A two-dimensional array of such structural units can be constructed with computer controlled individual units to form an array of sound sources with controlled phase and amplitude. The unit can serve as sound wave detector for the same reason as it can serve as a sound emitter. If two units are placed together as one combined unit, with one serving as detector of incoming sound, and the other to emitting waves with the right amplitude and phase, it is possible to attenuate the outgoing waves either in reflection or in transmission. It is further possible to use the combined unit selectively in reflection and in transmission There could even be some empty channel besides the combined unit, which would render a broadband active control noise filter that are air flow transparent, because the membrane emitters can be driven hard to even cancel the waves through the air channels.

FIG. 10A shows the side cross section view of a two-cell combined unit 1001. The incoming sound wave from the right side excites first cell 1011, and the electric signal is sent to controller 1013. Controller 1013 properly phase shifts and amplifies the signal, such that the sound wave emitted by second cell 1021 driven by the output of controller 1013 provides active noise reduction (ANR). The ANR cancels the wave that is transmitted through the two cells 1011, 1021, so that minimum transmission occurs. This applies to any form of sound waves; i.e., they can be broad band or narrow band. If the emitter emits higher intensity waves, it can even cancel the sound waves through its vicinity, as shown schematically in FIG. 10C. A 2D array of such units can form a broadband active control noise barrier with substantial portion of area transparent for free air flow.

The sound attenuation is achieved by causing the central active element to vibrate in the opposite phase as the sound waves in the empty channels, therefore canceling their contribution. This results in the whole device acting to provide sound attenuation, with empty channels providing air flow.

CONCLUSION

It will be understood that many additional changes in the details, materials, steps and arrangement of parts, which have been herein described and illustrated to explain the nature of the subject matter, may be made by those skilled in the art within the principle and scope of the invention as expressed in the appended claims.

What is claimed is:

1. A sound attenuation panel comprising:

a substantially acoustically transparent, rigid frame with a planar geometry divided into a plurality of individual cells configured for attenuating sound;

a sheet of a flexible material fixed to the rigid frame;

each individual cell having a weight fixed to a membrane;

the planar geometry of each individual cell, a flexibility of the flexible material and the respective weight thereon establishing a base resonant frequency of the sound attenuation; and at least a plurality of the individual cells having a first electromagnetic or electrostatic response unit configured to modify a resonant frequency of the individual cell, wherein the central weight has a disk shape polarized by she electric field to form an electric dipole.

2. The sound attenuation panel of claim 1, further comprising:

the modified resonant frequency by at least a plurality of the cells having a non-uniform electric field generated by a pair of electrodes maintained at different electric potential with a central weight made of either dielectric or metallic substance, or by a non-uniform magnetic field generated by an electric current coil with a central weight made of a ferromagnetic substance.

3. The sound attenuation panel of claim 1, further comprising the cells having a generally two-dimensional structure.

4. The sound attenuation panel of claim 1, further comprising:

a feedback circuit connected to the first electromagnetic or electrostatic response unit;

the feedback circuit connected to the first electromagnetic or electrostatic response unit, thereby sensing acoustic vibrations or waves and providing information concerning the acoustic vibration or waves for external detection of the presence of acoustic sources; and an output circuit, responsive to the feedback circuit, for adjusting the resonant frequency of the sound attenuation structure.

5. The sound attenuation panel of claim 1, further comprising:

a central platelet supported by the sheet of flexible material;

a first electrode positioned on one side of the central platelet; and a second electrode positioned on an opposite side of the central platelet in an opposing relationship with the first electrode, wherein an electric voltage between the first and second electrodes establishes an electrostatic field across the sheet of flexible material and the central platelet in accordance with a distance between the first and second electrodes as established by the thickness of the central platelet, wherein the cell without voltage applied between the first and second electrodes has a predetermined resonant frequency, and a voltage applied between the electrodes results in additional support for the membrane, thereby increasing the resonant frequency of the cell.

6. The sound attenuation panel of claim 5, further comprising:

the first electrode comprising a conductive film coated on at least one of the membrane and the platelet;

the second electrode comprising a conductive mesh positioned against at least one of the membrane and the platelet; and at least one of the first and second electrodes operatively connected to a connection electrode.

7. The sound attenuation panel of claim 1, further comprising:

a first electrode positioned on one side of the sheet of flexible material; and a second electrode positioned on an opposite side of the sheet of flexible material in an opposing relationship with the first electrode, wherein an electric voltage between the first and second electrodes establishes an electrostatic field across the sheet of flexible material in accordance with a distance between the first and second electrodes as established by the thickness of the sheet of flexible material, wherein the cell without voltage applied between the first and second electrodes has a predetermined resonant frequency, and a voltage applied between the electrodes results in additional support for the membrane, thereby increasing the resonant frequency of the cell.

8. The sound attenuation panel of claim 7, further comprising:

the first electrode comprising a conductive film coated on the membrane;

the second electrode comprising a conductive mesh positioned against the membrane; and at least one of the first and second electrodes operatively connected to a connection electrode.

9. The sound attenuation panel of claim 1, further comprising:

the first electromagnetic or electrostatic response units modifying the resonant frequency of the cell by using a pair of non-planar electrodes maintained at different electric potential to apply a non-uniform electric field to a central weight.

10. The sound attenuation panel of claim 1, further comprising:

at least one of the cells having a second electromagnetic or electrostatic response unit, with the first electromagnetic or electrostatic response unit and the second electromagnetic or electrostatic response unit placed together as one combined unit, with a first unit of the combined unit serving as detector of incoming sound, and a second unit of the combined unit serving to emit waves with a right amplitude and a right phase, the combined unit permitting attenuation of outgoing waves selectively in reflection and in transmission.

11. The sound attenuation panel of claim 1, further comprising:

at least one of the cells having a second electromagnetic or electrostatic response unit, with the first electromagnetic or electrostatic response unit and the second electromagnetic or electrostatic response unit placed together as one combined unit, with a first unit of the combined unit serving as detector of incoming sound, and a second unit of the combined unit serving to emit waves with a right amplitude and a right phase, the combined unit permitting attenuation of outgoing waves either in reflection or in transmission.

12. The sound attenuation panel of claim 1, further comprising:

at least a plurality of the cells having a first electrode formed of an electric coating on the sheet of flexible material;

the plurality of cells having a second electrode fixed to the sheet of flexible material with a dielectric separation from the first electrode; and the plurality of the cells having a non-uniform electric field generated by a pair of electrodes maintained at different electric potential, the electrodes configured to modify the resonant frequency of the cell in response to the different electric potential.

13. The sound attenuation panel of claim 12, further comprising:

each cell having a platelet fixed to the membrane; and the planar geometry of each individual cell, the flexibility of the flexible material and a mass of the material, including the weight of the platelet establishing the base resonant frequency of the sound attenuation.

14. The sound attenuation panel of claim 1, further comprising:

the first electromagnetic or electrostatic response units modifying the resonant frequency of the cell by using a pair of electrodes maintained applying electric potentials to the weight fixed to a membrane; and at least one of the electrodes formed as a conductive mesh.

15. A method for sound attenuation comprising:

providing the panel of claim 1; and actuating the electromagnetic or electrostatic response units to control the frequency response of the individual cells for attenuating sound.

16. A method for sound attenuation comprising:

providing a panel comprising a substantially acoustically transparent, rigid frame with a planar geometry divided into a plurality of individual cells with a first electromagnetic or electrostatic response unit for at least a plurality of the individual cells the planar geometry of each individual cell, the flexibility of a flexible material and a respective weight thereon establishing a base resonant frequency of the sound attenuation;

actuating the electromagnetic or electrostatic response units to control the frequency response of the individual cells for attenuating sound; and the electromagnetic or electrostatic response units modifying the resonant frequency of the individual cell by using a pair of non-planar electrodes maintained at different electric potential to apply a non-uniform electric field to a central weight.

17. The method of claim 16, further comprising using the electromagnetic response units to apply, as the non-uniform electric field, an electrostatic field generated across a central weight comprising a dielectric substance.

18. The method of claim 16, further comprising using the electromagnetic response units to generate a magnetic field generated across a central weight comprising a ferromagnetic substance.

19. The method of claim 16, wherein the central weight forms an electric dipole.

20. The method of claim 16, further comprising:

using the electromagnetic or electrostatic response units modifying the resonant frequency by using a central weight made of permanent magnetic substance and a non-uniform magnetic field generated by an electric current coil.

21. The method of claim 16, further comprising:

providing a second electrostatic or electromagnetic response unit in at least one of the cells, with the two units placed together as one combined unit, with a first unit of the combined unit serving as detector of incoming sound, and the second unit of the combined unit serving to emit waves with a right amplitude and a right phase; and using the combined unit to attenuate outgoing waves selectively in reflection and in transmission.

22. The method of claim 16, further comprising:

providing a second electrostatic or electromagnetic response unit in at least one of the cells, with the first electromagnetic or electrostatic response unit and the second electromagnetic or electrostatic response unit placed together as one combined unit, with a first unit of the combined unit serving as detector of incoming sound, and a second unit of the combined unit serving to emit waves with a right amplitude and a right phase; and using the combined unit to attenuate outgoing waves either in reflection or in transmission.

23. A sound attenuation panel comprising:

a substantially acoustically transparent, rigid frame with a planar geometry divided into a plurality of individual cells configured for attenuating sound;

a sheet of a flexible material fixed to the rigid frame;

each individual cell having a weight fixed to a membrane;

the planar geometry of each individual cell, a flexibility of the flexible material and the respective weight thereon establishing a base resonant frequency of the sound attenuation;

at least a plurality of the individual cells having a first electromagnetic or electrostatic response unit configured to modify a resonant frequency of the individual cell; and the first electromagnetic or electrostatic response units modifying the resonant frequency of the cell by using a pair of non-planar electrodes maintained at different electric potential to apply a non-uniform electric field, wherein the non-uniform electric field comprises an electromagnetic field generated across a central weight comprising selected from the group consisting of a dielectric substance or a ferromagnetic substance.

24. The sound attenuation panel of claim 23, wherein the non-uniform electric field comprises an electrostatic field generated across a central weight comprising a dielectric substance.

25. The sound attenuation panel of claim 23, wherein the non-uniform electric field comprises an electrostatic field generated across a membrane comprising a dielectric substance.

26. The sound attenuation panel of claim 23, wherein the non-uniform electric field comprises a magnetic field generated across a central weight comprising a ferromagnetic substance.

27. The sound attenuation panel of claim 23, wherein the central weight has a disk shape polarized by the electric field to form an electric dipole.

28. A sound attenuation panel comprising:

a substantially acoustically transparent, rigid frame with a planar geometry divided into a plurality of individual cells configured for attenuating sound;

a sheet of a flexible material fixed to the rigid frame;

each individual cell having a weight fixed to a membrane;

the planar geometry of each individual cell, a flexibility of the flexible material and the respective weight thereon establishing a base resonant frequency of the sound attenuation;

at least a plurality of the individual cells having a first electromagnetic or electrostatic response unit configured to modify a resonant frequency of the individual cell; and the first electromagnetic or electrostatic response units modifying the resonant frequency by using a central weight made of a permanent magnetic substance and a non-uniform magnetic field generated by an electric current coil.

29. A sound attenuation panel comprising:

a substantially acoustically transparent, rigid frame with a planar geometry divided into a plurality of individual cells configured for attenuating sound;

a sheet of a flexible material fixed to the rigid frame;

each individual cell having a weight fixed to a membrane;

the planar geometry of each individual cell, a flexibility of the flexible material and the respective weight thereon establishing a base resonant frequency of the sound attenuation;

at least a plurality of the individual cells having a first electromagnetic or electrostatic response unit configured to modify a resonant frequency of the individual cell;

a center platelet mounted to the sheet of flexible material, the sheet of flexible material and establishing the resonant frequency of the cell; and one of the electrodes forming at least a portion of the center platelet, and a second one of the electrodes provided separately from the center platelet and having a physical separation from the center weight, in a direction transverse to the sheet of flexible material.

30. A sound attenuation panel comprising:

a substantially acoustically transparent planar, rigid frame divided into a plurality of individual cells configured for attenuating sound;

a sheet of a flexible material fixed to the rigid frame;

a center platelet mounted to the sheet of flexible material, the sheet of flexible material and the center platelet establishing a resonant frequency of the cell; and at least a plurality of the individual cells having a non-uniform electric field generated by a pair of electrodes maintained at different electric potential, a first one of the electrodes forming at least a portion of the center platelet, and a second one of the electrodes provided separately from the center platelet and having a physical separation from the center weight, in a direction transverse to the sheet of flexible material, the electrodes configured to modify the resonant frequency of the individual cell in response to the different electric potential.

31. A sound attenuation panel comprising:

a substantially acoustically transparent, rigid frame with a planar geometry divided into a plurality of individual cells configured for attenuating sound;

a sheet of a flexible material with a mass fixed to the rigid frame;

the planar geometry of each individual cell, the flexibility of the flexible material and the mass of the material suspended by the rigid frame establishing a base resonant frequency of the sound attenuation;

at least a plurality of the individual cells having a first electrode formed of an electric coating on the sheet of flexible material;

the plurality of cells having a second electrode fixed to the sheet of flexible material with a dielectric separation from the first electrode;

at least one of the electrodes formed as a conductive mesh; and the plurality of the cells having a non-uniform electric field generated by a pair of electrodes maintained at different electric potential, the electrodes configured to modify the resonant frequency of the cell in response to the different electric potential.

32. The sound attenuation panel of claim 31, further comprising:

each individual cell having a platelet with a weight fixed to the membrane; and the planar geometry of each individual cell, the flexibility of the flexible material and the mass of the material, including the weight of the platelet establishing the base resonant frequency of the sound attenuation.

* * * * *